US006109307A

United States Patent [19]

Stang et al.

[11] Patent Number: 6,109,307

[45] Date of Patent: Aug. 29, 2000

[54] THREAD CLAMPING DEVICE FIGURING WEFT THREADS ON JACQUARD MACHINES

[75] Inventors: Hans-Peter Stang; Lorenz Steinbach, both of Bernkastel-Kues, Germany

[73] Assignee: Mageba Textilmaschinen GmbH & Co., Bernkastel-Kues, Germany

[21] Appl. No.: 09/306,867

[22] Filed: May 7, 1999

[30] Foreign Application Priority Data

May 11, 1998 [DE] Germany ..... 198 21 028

[51] Int. Cl.[7] ..... D03C 3/42; D03D 47/34

[52] U.S. Cl. ..... 139/194; 139/59; 139/450; 242/150 M

[58] Field of Search ..... 139/194, 116.5, 139/450, 59; 242/150 M

[56] References Cited

U.S. PATENT DOCUMENTS

| | | | |
|---|---|---|---|
| 3,050,088 | 8/1962 | Schaffer | 139/194 |
| 4,256,149 | 3/1981 | Franklin . | |
| 4,572,247 | 2/1986 | Speich | 139/455 |

FOREIGN PATENT DOCUMENTS

| | | |
|---|---|---|
| 7346075 | 5/1974 | Germany . |

*Primary Examiner*—Andy Falik
*Attorney, Agent, or Firm*—Brown & Wood, LLP

[57] ABSTRACT

A thread clamping device, particularly for the figuring weft threads on jacquard machines, in which figuring weft threads, e.g. those on jacquard looms, are only picked from time to time corresponding to the figured form of the woven jacquard fabric, with the figuring weft threads being held under tension and released as required, during their stationary period, by thread clamping devices which are controlled via the harness thread of the associated figuring weft cord heald.

4 Claims, 1 Drawing Sheet

THREAD CLAMPING DEVICE FIGURING WEFT THREADS ON JACQUARD MACHINES

BACKGROUND OF THE INVENTION

This invention relates to a thread clamping device, particularly for the figuring weft threads on jacquard machines.

These figuring weft threads, such as those which are present on jacquard looms for example, are only picked from time to time so that they correspond to the figured form of the textile. During its stationary period, however, the figuring weft thread has to be held under tension and has to be released only as required.

In thread clamping devices of this type for figured weft threads which were known hitherto, the thread control system is designed so that the clamping device is ineffective when thread is pulled off and is effective to a predetermined extent when the thread tension of the figuring weft thread is slackened. This clamping device, which operates based on differences in thread tension of the figuring weft thread, result in considerable mechanical stress on the figuring weft thread. Moreover, experience has shown that due to the resulting different thread tensions in the figuring weft thread the textile produced is non-uniform, e.g. it may have an uneven edge structure.

The object of the present invention therefore consists of proposing a thread clamping device of the type cited above, which ensures accurate introduction of the figuring weft thread with a low level of mechanical stress on the figuring weft thread whilst the tension remains constant.

SUMMARY OF THE INVENTION

This object is achieved by providing for the thread clamping device to be positively controlled on the associated figuring weft thread heald. This can be effected via the harness cord of the jacquard machine, for example, but can also be effected by other control pulses.

In one advantageous embodiment, the clamping device comprises a spring-loaded clamping plate for securing the figuring weft thread, which clamping plate is connected to the harness cord of the associated figuring weft thread heald via a control line or the like. The clamping plate advantageously cooperates with a swivel-mounted lever, one end of which is connected to the harness cord of the associated figuring weft thread heald via a control line or the like.

In another advantageous embodiment, the thread clamping device comprises a spring-loaded clamping plate for securing the figuring weft thread, which clamping plate can be moved into a release position by an electromagnet, wherein the electromagnet is controlled by the electronic control system of the harness cord of the associated figuring weft thread heald.

BRIEF DESCRIPTION OF THE DRAWINGS:

The invention is illustrated by way of example in the drawings, where.

DETAILED DESCRIPTION OF THE PREFERRED EMBODIMENTS

Figure 1:
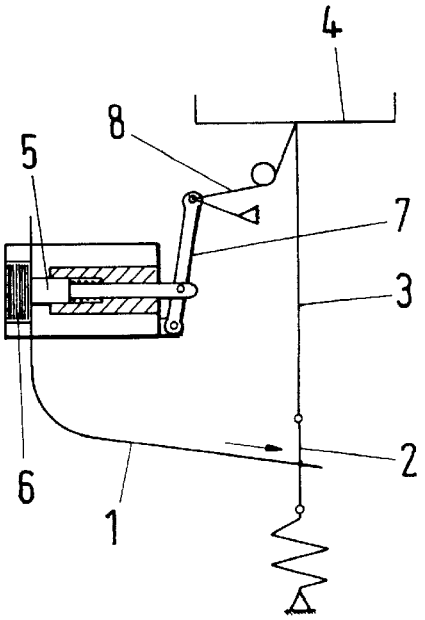
FIG. 1 shows a schematic view of a mechanically operated thread clamping device in its clamping position.

As shown in FIGS. 1 to 4, a figuring weft thread 1 is introduced in the known manner via a figuring weft thread heald 2. The figuring weft thread heald 2 is moved in the known manner via a harness cord of a jacquard machine 4, control of the harness thread 3 generally being effected electronically.

As shown in FIGS. 1 to 4, the clamping device consists of a spring-loaded clamping plate 5, which cooperates with a counter-pressure plate 6.

Figure 2:
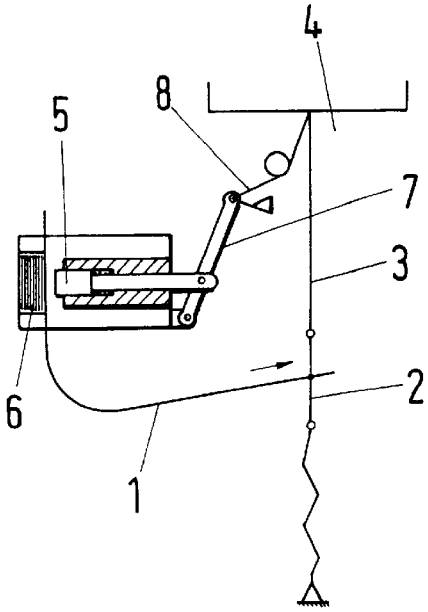
FIG. 2 shows a schematic view of the thread clamping device of FIG. 1 in its release position.
Figure 3:
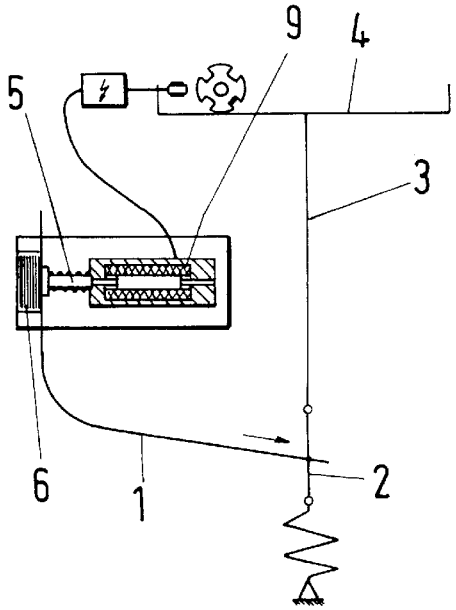
FIG. 3 shows a schematic view of an electronically operated thread clamping device in its clamping position.

As shown in FIGS. 1 to 3, in its clamping position the spring-loaded clamping plate 5 presses the figuring weft thread 1 on to the counter-pressure plate 6, so that the figuring weft thread 1 is held.

As shown in FIGS. 1 and 2, the spring-loaded clamping plate 5 is connected to a swivel-mounted lever 7, one end of which is connected via a control line 8 to the harness cord 3 of the associated figuring weft thread heald 2. If the harness cord 3 of the jacquard machine is activated and the control line 8 is thus pulled, the lever 7 is also moved into the position illustrated in FIG. 2, so that the figuring weft thread 1 is released.

Figure 4:
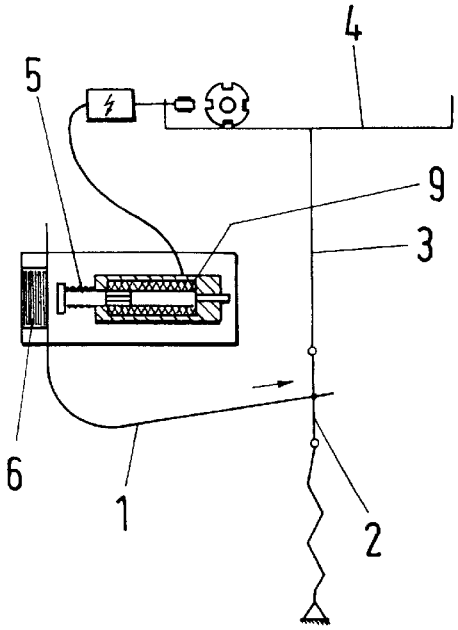
FIG. 4 shows a schematic view of the thread clamping device of FIG. 3 in its release position.

In the embodiment of the clamping device shown in FIGS. 3 and 4, the clamping plate 5 is attached to an electromagnet 9 which is controlled by the control pulse of the jacquard machine 4 for the harness cord 3 of the associated figuring weft thread heald 2.

The proposed solution has the advantage that when the figuring weft thread heald 2 is operated by the jacquard machine via the associated harness cord 3, the clamping device is also operated and released simultaneously, so that the figuring weft thread 1 can enter the textile unimpeded and without altering the thread tension. This is not only possible for the picking of one weft, but is also possible for a plurality of weft pickings in succession. Since the control of the clamping device according to the invention is independent of changes in the thread tension of the figuring weft thread 1, the predetermined thread tension always remains constant, so that a more uniform textile structure is ensured, particularly at the edges.

What is claimed is:

1. A thread clamping device for figuring weft threads on jacquard machines, comprising means connectable with a harness cord of an associated figuring weft thread heald for enabling control of the thread clamping device by the harness cord of the associated figuring weft thread heald.

2. A thread clamping device according to claim 1, wherein the thread clamping device comprises a spring-loaded clamping plate for securing the figuring weft thread, and wherein the control enabling means comprises a control line for connecting the clamping plate to the harness cord of the associated figuring weft thread heald.

3. A thread clamping device according to claim 2, wherein the control enabling means further comprises a swivel-mounted lever cooperating with the clamping plate and having one end thereof connected to the harness cord by the control line.

4. A thread clamping device according to claim 1, wherein the thread clamping device comprises a spring-loaded clamping plate for securing the figuring weft thread, and wherein the control enabling means comprises an electromagnet for moving the clamping plate to a release position of the clamping plate, and means connecting the electromagnet with an electronic control system of the harness cord of the associated figuring weft thread heald.

* * * * *